US008757255B2

(12) United States Patent
Toguem Nguete et al.

(10) Patent No.: US 8,757,255 B2
(45) Date of Patent: Jun. 24, 2014

(54) HYDROCARBONS PRODUCTION INSTALLATION AND METHOD

(75) Inventors: Emmanuel Toguem Nguete, Pau (FR); Jean-Louis Beauquin, Saint-Faust (FR)

(73) Assignee: Total S.A., Courbevoie (FR)

( * ) Notice: Subject to any disclaimer, the term of this patent is extended or adjusted under 35 U.S.C. 154(b) by 128 days.

(21) Appl. No.: 12/677,820

(22) PCT Filed: Sep. 9, 2008

(86) PCT No.: PCT/FR2008/001260

§ 371 (c)(1),
(2), (4) Date: Mar. 11, 2010

(87) PCT Pub. No.: WO2009/066034

PCT Pub. Date: May 28, 2009

(65) Prior Publication Data

US 2010/0200224 A1 Aug. 12, 2010

(30) Foreign Application Priority Data

Sep. 11, 2007 (FR) ..... 07 06348

(51) Int. Cl.
*E21B 43/12* (2006.01)

(52) U.S. Cl.
USPC ..... 166/250.15; 166/263

(58) Field of Classification Search
USPC ..... 166/250.15, 263
See application file for complete search history.

(56) References Cited

U.S. PATENT DOCUMENTS 3,016,833 A * 1/1962 Creed ..... 417/85
3,175,514 A * 3/1965 McMurry ..... 417/115
3,568,771 A * 3/1971 Vincent et al. ..... 166/250.15
4,718,824 A * 1/1988 Cholet et al. ..... 417/14
5,393,202 A 2/1995 Levallois
6,041,856 A 3/2000 Thrasher et al.

(Continued)

FOREIGN PATENT DOCUMENTS

| | | |
|---|---|---|
| EP | 0549439 | 6/1993 |
| FR | 2920817 | 3/2009 |
| GB | 2419905 | 5/2006 |
| WO | WO 2009/066034 | 5/2009 |

OTHER PUBLICATIONS

International Search Report and Written Opinion with English Translation for PCT/FR2008/001260, May 14, 2009 (mailing date), Total S.A.

(Continued)

*Primary Examiner* — David Andrews
*Assistant Examiner* — Ronald Runyan
(74) *Attorney, Agent, or Firm* — Adeli LLP

(57) ABSTRACT

Some embodiments include a heavy-oil-based hydrocarbons effluent production installation for the production of hydrocarbons from at least one well. The installation includes an effluent-lightening fluid injection system at the bottom of the well, an effluent-evacuation pump, a plurality of sensors that measure physical units relating to the installation, and an automated device suitable for optimizing the lightening-fluid injection flow-rate and for regulating the pump speed. The automated device regulates the pump speed according to the physical units and a predetermined target production value. The speed of the pump and the physical units are within a predetermined range of values. some embodiments include a hydrocarbons production method in such an installation. Some embodiments make it possible to ensure a minimum consumption of lightening fluid, while ensuring good operation of the pump and good productivity of the well.

19 Claims, 2 Drawing Sheets

(56) References Cited

U.S. PATENT DOCUMENTS

| | | | | |
|---|---|---|---|---|
| 6,343,656 | B1 | 2/2002 | Vazquez et al. | |
| 7,243,726 | B2 * | 7/2007 | Ohmer | 166/304 |
| 2005/0166961 | A1 | 8/2005 | Means et al. | |
| 2005/0217350 | A1 * | 10/2005 | Jabusch et al. | 73/64.55 |

OTHER PUBLICATIONS

International Preliminary Report on Patentability with English Translation for PCT/FR2008/001260, Dec. 29, 2009 (completion date), Total S.A.

* cited by examiner

HYDROCARBONS PRODUCTION INSTALLATION AND METHOD

CLAIM OF BENEFIT TO PRIOR APPLICATIONS

This application is a national stage application of PCT Patent Application PCT/FR2008/001260, filed on Sep. 9, 2008, published as WO2009/066034, which claims the benefit of French Patent Application FR 0706348 filed Sep. 11, 2007. All of the above-mentioned applications are incorporated herein by reference.

FIELD OF THE INVENTION

The present invention relates to a hydrocarbons production installation and in particular a heavy oil production installation. The invention also relates to a hydrocarbons production method.

BACKGROUND OF THE INVENTION

Hydrocarbons are found in underground reservoirs. Generally, hydrocarbons are composed of oil and gas mixed with water. This mixture is called effluent. The production of hydrocarbons is made possible by drilling wells as far as the hydrocarbons reservoirs. A hydrocarbons production installation enables the hydrocarbons to be recovered so that they can be processed for subsequent use.

Heavy oil is very viscous, of the order of several thousand Pascal second. In order to produce it, it is necessary to make it less viscous.

At least two heavy oil production methods are known for this purpose: in particular, hot production and cold production.

Cold production consists of reducing the viscosity of the oil by injecting a diluent into the heavy oil. The injection of diluent thus makes it possible to increase the productivity of the well, by reducing the friction and lightening the weight of the column. The injection of diluent also makes it possible to improve the oil/water separation at the central operations plant. It is necessary to control the injection of diluent in order to avoid an overconsumption of diluent or, conversely, damage to the installation if the viscosity of the oil is not sufficiently reduced after the injection of diluent. The injection of diluent is generally carried out manually. However, manual management does not allow the injection to be optimized.

A real-time optimization system for effluent pumping operations is known from U.S. Pat. No. 6,041,856 A. This system comprises a plurality of sensors allowing the pump operation to be monitored. A computerized system is suitable to interpret the operating conditions of the pump in service, to increase or decrease the production of the pump in order to maintain the optimum dynamic fluid level. A diluent is introduced into the well to control the viscosity of the effluent. The quantity of diluent is controlled via a regulating valve. However, this control is carried out manually, which does not allow the injection of diluent to be optimized.

The aim of the invention is to propose a hydrocarbons production installation and a hydrocarbons production method making it possible to provide a real-time optimization of the quantity of diluent to be injected into the effluent, while ensuring good operation of the pump and good productivity of the well.

SUMMARY OF THE INVENTION

This aim is achieved by a heavy-oil-based hydrocarbons effluent production installation for the production of hydrocarbons from at least one well, the installation comprising:

- an effluent-lightening fluid injection system at the bottom of the well,
- an effluent-evacuation pump,
- a plurality of sensors measuring physical units relating to the installation,
- an automated device suitable for optimizing the lightening-fluid injection flow-rate and for regulating the pump speed, according to the physical units and a predetermined target production value, the pump speed and the physical units each being comprised within a predetermined range of values.

According to another feature, the diluent-injection flow-rate is proportional to the pump speed.

According to another feature, the diluent-injection flow-rate is proportional to the gravity index of the effluent.

According to another feature, one of the sensors is a first pressure sensor suitable for being located at the wellhead and another sensor is a second pressure sensor suitable for being located at the discharge of the pump, the automated device being suitable for calculating the gravity index of the effluent according to the data provided by said first and second pressure sensors.

According to another feature, one of the sensors is a first temperature sensor suitable for being located at the wellhead, the automated device being suitable for monitoring the effluent flow-rate at the wellhead according to the data provided by said first temperature sensor.

According to another feature, one of the sensors is a second temperature sensor suitable for being located at the suction of the pump, the automated device being suitable for monitoring the occurrence of a hole in a tubing evacuating effluent from the pump, according to the data provided by said second temperature sensor.

According to another feature, one of the sensors is a vibration sensor suitable for being located at the discharge of the pump, the automated device being suitable for monitoring the occurrence of excessive pump vibrations according to the data provided by said vibration sensor.

According to another feature, two of the sensors are third and fourth pressure sensors suitable for being located respectively at the suction of the pump and at the outlet of a casing in an annular space, the automated device being suitable for calculating the submersion height of the pump according to the data provided by said third and fourth pressure sensors.

According to another feature, the automated device is suitable for optimizing the height of the effluent above the pump by regulating the ventilation of an annular space containing gas.

According to another feature, one of the sensors is a fourth pressure sensor suitable for being located in an annular space, the automated device being suitable for monitoring the passage of gas through the pump according to the data provided by said fourth pressure sensor.

According to another feature, the lightening fluid is a diluent.

The aim of the invention is also achieved by a heavy-oil-based hydrocarbons effluent production method in an installation described above, the method comprising the following phase:

- a phase of stable and continuous production mode, implemented by the automated device, the phase of stable and continuous production mode comprising the optimization of the lightening-fluid injection flow-rate and the regulation of the pump speed according to the physical units and the target value, the pump speed and the physical units each being comprised within a predetermined range of values.

According to another feature, the method further comprises, before the phase of stable and continuous production mode, a phase of starting-up a well, the phase of starting-up the well comprising the following steps:

- a step of injection of effluent-lightening fluid at the bottom of the well by the automated device,
- a step of starting-up an effluent evacuation pump by the automated device,
- a step of stabilizing the speed at a first value for a determined period,
- a step of increasing the pump speed by the automated device until a target value is reached,
- a step of reducing the rate-flow of injection of lightening fluid,
- with a monitoring of the physical units by the automated device using the plurality of sensors during the phase of starting-up the well.

According to another feature, the step of minimizing the lightening-fluid injection flow-rate and regulating the pump speed comprises the following step:

- when at least one physical unit leaves the predetermined range of values, the pump speed and the fluid injection flow-rate are increased or reduced by the automated device until each physical unit is again comprised within the predetermined corresponding range of values.

BRIEF DESCRIPTION OF THE DRAWINGS

Other features and advantages of the invention will appear on reading the following detailed description of the embodiments of the invention, given solely by way of example and with reference to the drawings which show.

DETAILED SPECIFICATION

The invention relates to an installation of production of effluent of hydrocarbons based on heavy oil from at least one well.

The hydrocarbons production installation comprises a system of injecting effluent-lightening fluid at the bottom of the well. This system is suitable for making the effluent less viscous.

The installation also comprises an effluent evacuation pump, suitable for evacuating the effluent to the wellhead.

The installation also comprises a plurality of sensors measuring physical units relating to the installation.

The installation also comprises an automated device suitable for optimizing the lightening-fluid injection flow-rate and regulating the pump speed according to the physical units and a predetermined target production value, the pump speed and the physical units each being comprised in a predetermined range of values.

The maintaining by the automated device of the physical units and the pump speed within a predetermined range of values makes it possible to ensure good operation of the pump without risk of damage. The regulation of the pump speed according to the target production value to be achieved, allows good productivity of the well to be ensured. The regulation of the pump speed according to the physical units allows good productivity of the well to be ensured, while ensuring good operation of the pump without risk of damage. Injecting diluent makes the effluent less viscous, which also makes it possible to ensure good productivity of the well. The optimization of the lightening-fluid injection flow-rate makes it possible to optimize the quantity of diluent to be injected in the effluent. The optimization of the lightening-fluid injection flow-rate according to the physical units makes it possible to optimize the quantity of diluent to be injected in the effluent, while providing good productivity of the well and good operation of the pump without risk of damage. The optimization of the lightening-fluid injection flow-rate according to the target production value to be achieved makes it possible to optimize the quantity of diluent to be injected in the effluent, while providing good productivity of the well. Thus the quantity of diluent is optimized, good operation of the pump is provided and the well has a good productivity.

The optimization of the lightening-fluid injection flow-rate results in a minimization of the quantity of lightening fluid used, the minimized quantity of lightening fluid being sufficient however to allow an optimization of production while avoiding any risk of damage to the installation, and in particular to the pump.

The wellhead is defined as being at ground level and the well bottom as being underground, at the level of the reservoir.

Figure 1:
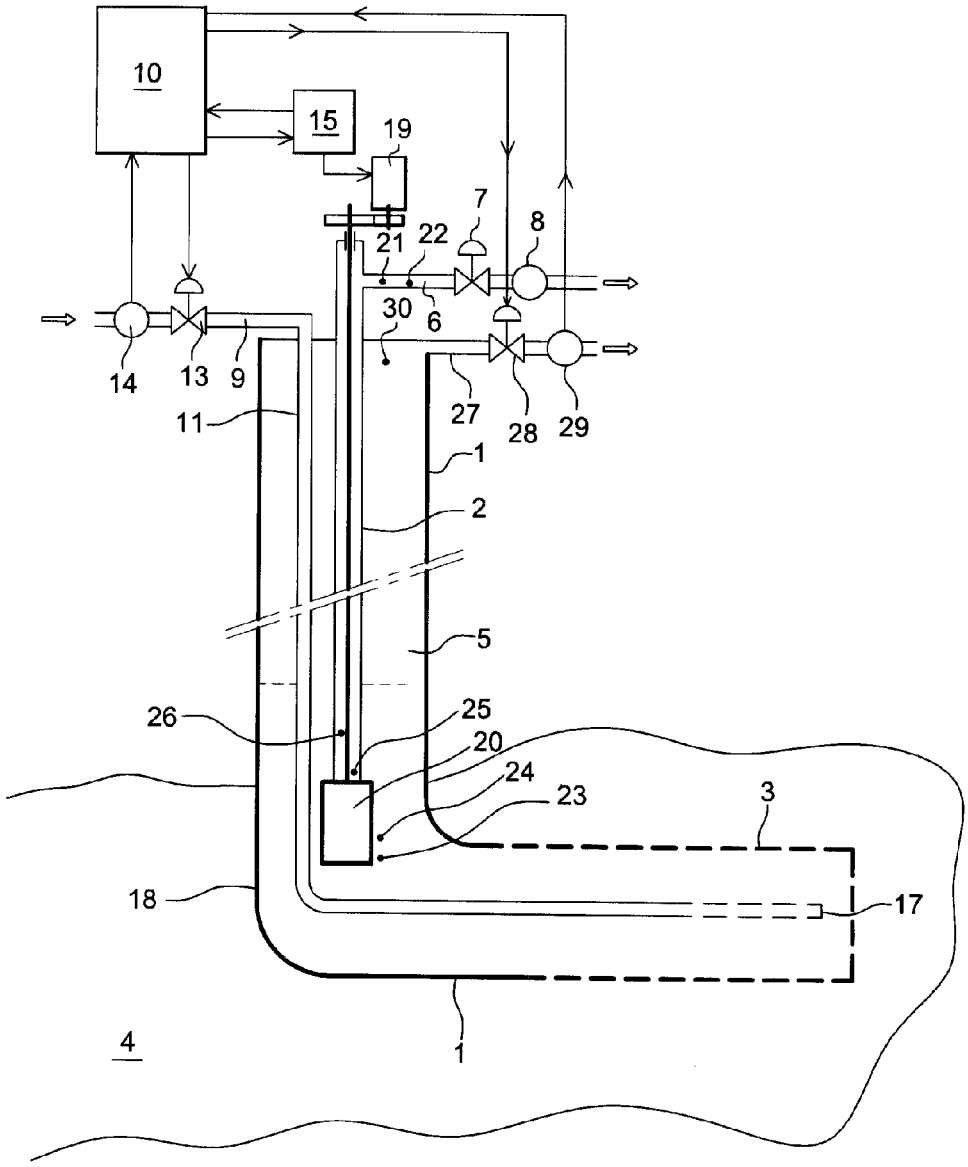
FIG. 1, a sectional view of a hydrocarbons production installation according to the invention, FIG. 2, a curve of the speed and the diluent flow-rate according to time.

FIG. 1 represents a sectional view of a hydrocarbons production installation according to the invention.

FIG. 1 shows a single well. However, the production of hydrocarbons preferably involves a large number of wells, for example approximately 300. Each well is equipped with the installation described below. A single automated device 10 controls the set of various wells, in order to optimize the production of the various wells simultaneously, allowing a saving in time. The effluents produced from the various wells are compatible, even if they come from different reservoirs. They are therefore all removed to the same effluent evacuation pipe 6. It is necessary for the flow-rate in this pipe to be homogeneous. To this end, the automated device must therefore coordinate the actions carried out on the different wells.

In the remainder of the description, for reasons of clarity, a single well will be considered, although this is not to be considered a limitation.

The hydrocarbons production installation comprises, for each well, a casing 1 delimiting the walls of the well. The casing 1 opens out at one of its ends at the ground surface. At its other end, the casing 1 is provided with a plurality of apertures 3 through which the effluent of the reservoir 4 passes into the well.

The casing comprises a substantially vertical part opening at the surface and being extended at its lower end by a substantially horizontal part. This type of well with a horizontal part is particularly suitable for the production of heavy oil. It allows the effluent to flow from the reservoir to the well by gravity. The apertures 3 are preferably distributed over the whole length of the horizontal part of the well, so as to facilitate the flow of the effluent by gravity from the reservoir to the well.

The installation also comprises a tubing 2, substantially concentric with the casing 1, but having a smaller diameter. An annular space 5 is thus defined between the external surface of the tubing 2 and the internal surface of the casing 1. The tubing 2 is suitable for evacuating the effluents of hydrocarbons, in particular the liquids (oil, water, etc). The annular space 5 is suitable for evacuating some of the gas from the effluent. A large part of the gas present in the effluent is evacuated via the annular space 5. To this end, the annular space 5 is connected to a gas-evacuation pipe 27. This gas-evacuation pipe 27 is equipped with a valve 28 regulating the gas flow-rate and a flowmeter 29 measuring the flow-rate of removed gas. The valve 28 and the flowmeter 29 are connected to the automated device.

The upper end of the tubing 2 is connected to an evacuation pipe 6, suitable for evacuating the effluents to a processing unit with a view to subsequent processing. The evacuation pipe 6 is equipped with a valve 7 regulating the effluent flow-rate and a flowmeter 8 suitable for measuring the effluent flow-rate in the evacuation pipe 6.

The installation also comprises a pumping system. The pumping system may comprise a single pump 20 or preferably two pumps in series, particularly suitable when a multiphase fluid is involved. The pumps are each driven by a motor 19. Each pump 20 is equipped with a variable speed drive 15. The variable speed drive makes it possible to regulate the pump speed. In order to avoid any damage, the pump speed must be comprised within a range of values determined by the pump manufacturer.

Each pump is for example a progressive cavity pump (PCP) or an electrical submersible pump (ESP).

In the remainder of the description, for ease of presentation, only one pump will be mentioned, although this is not to be considered a limitation.

The pump 20 is connected to the motor 19, located at the surface, by a wire connection. The variable speed drive 15 is also located at the surface; it is connected to the motor 19.

The pump 20 is fixed to the tubing 2. It closes the lower end thereof. Thus it prevents too large a quantity of gas from passing through the tubing.

The installation also comprises a lightening fluid injection system. The lightening fluid is for example a diluent. In the remainder of the description, the term diluent will be used non-limitatively. The diluent is for example a hydrocarbon of a lower density than that of the oil contained in the reservoir. The oil+diluent mixture then has a viscosity lower than that of the oil alone. The flow of the mixture is thus facilitated.

The diluent injection system comprises a diluent tank (not shown), as well as a pump (not shown) allowing the diluent to be injected into the well.

The diluent injection system comprises a supply pipe 9 suitable for conveying the additive or diluent from the additive or diluent reservoir to the well. The supply pipe 9 continues via a drain 11 which extends to the end of the well. The drain 11 is equipped with a valve 13 regulating the flow-rate of diluent in the drain 11 and a flowmeter 14 suitable for measuring the flow-rate of diluent in the drain 11.

The drain 11 is suitable for injecting diluent at the well bottom. The drain 11 then comprises a plurality of apertures 17 at its lower end opposite the tank of diluent. These apertures 17 can be located either at the suction 18 of the pump, or at the horizontal end of the casing 1, as shown in FIG. 1.

The installation also comprises an automated device 10 suitable for commanding the installation. In order to provide good productivity of the well, and preferably maximum productivity, a target production value to be achieved is fixed. This target production value is for example:

a value of the effluent flow-rate at the wellhead, a value of the effluent pressure at the suction of the pump, a submersion height of the pump, a predetermined value of the rotation speed of the pump.

The automated device 10 then regulates the speed of the pump 20 by acting on the variable speed drive 15 such that the pump speed makes it possible to achieve the chosen target value while avoiding any damage to the pump. In parallel, the automated device 10 acts on the diluent flow-rate regulating valve 13 in order to optimize the quantity of diluent to be injected into the well. The injection of diluent reduces the torque value on the rods transmitting the rotary movement from the electric motor at the surface to the pump located at the well bottom. The injection of diluent thus also plays a part in achieving the chosen target value. These two parallel actions of the automated device 10 (regulating the speed and optimizing the quantity of diluent to be injected) are linked to each other and are thus implemented simultaneously and in real time. These operations are carried out according to the operating conditions of the installation. The operating conditions of the installation are characterized by physical units, such as the pressure and the temperature at various points of the installation, or also the vibrations at the pump. These different physical units are measured by a set of sensors 21-26, 30 and are monitored in real time by the automated device 10.

The physical units measurements are transmitted by the sensors to the automated device 10, which then calculates a certain number of physico-chemical values from these physical units. Among the physico-chemical values calculated by the automated device, there can be mentioned the flow-rate of the effluent at various points of the installation, the submersion height of the pump, the average density of the effluent in the casing, or also the torsion moment of the transmission rods.

The sensors, the measured physical units and the calculated physico-chemical values will be detailed below.

The automated device 10 is parameterized so as to ensure operating conditions in which the system operates without risk of damaging the pump, while ensuring good productivity for the well. To this end, the various measured physical units or the various calculated physico-chemical values must each always lie within a predetermined range of values. Each measured physical unit and each calculated physico-chemical value is maintained within in a predetermined range of values by the automated device 10. To this end, the automated device controls the pump speed and the fluid injection flow-rate.

If at least one of the sensors measures a physical unit which is not within a predetermined range of values or if the automated device calculates a physico-chemical value which is not within a predetermined range of values, the system is not experiencing satisfactory operating conditions. The automated device will then act on the variable speed drive 15 so as to change the pump speed and on the diluent flow-rate valve 13 so as to change the diluent flow-rate so that the measured physical unit or the calculated physico-chemical value once again lies within the predetermined range of values, so that the operating conditions are satisfactory once more.

Moreover, even before a physical unit leaves the predetermined range, if the automated device detects that it is approaching a boundary of said range, the automated device will regulate the pump speed and the flow-rate of diluent so that the physical unit moves away from the boundary. This allows any malfunctions to be anticipated.

Thus the automated device 10 permanently and simultaneously, according to the operating conditions, adjusts the rotation speed of the pump and the diluent-injection flow-rate, while ensuring that the operating ranges of the installation are respected, namely the predetermined ranges of values authorized for the various physical units, as well as the range of values authorized for the pump speed by the manufacturer, as mentioned above.

Optimization of the production is carried out by the automated device which regulates the pump speed and optimizes the diluent-injection flow-rate both at once, i.e. at the same time, and in real time and according to the physical units and a target production value, while maintaining the pump speed and the physical units each within a predetermined range of values.

The automated device 10 is also parameterized so as to minimize the diluent-injection flow-rate. The diluent-injection flow-rate $Q_{diluent}$ is governed by various parameters.

Preferably, the diluent-injection flow-rate $Q_{diluent}$ is slaved to the rotation speed of the pump, according to the following formula:

$$Q_{diluent}=k*(\text{pump speed})$$

where k is a constant specific to each well, defined for example by the reservoir engineer; thus the diluent-injection flow-rate is directly linked to the rotation speed of the pump. The automated device can thus easily regulate the pump speed and optimize the diluent-injection flow-rate at the same time.

As a variant, the diluent-injection flow-rate $Q_{diluent}$ is slaved to the average density of the effluent in the casing 1, according to the following formula:

$$Q_{diluent}=k'*(API)$$

where k' is a constant specific to each well, defined for example by the reservoir engineer, and where API is the gravity index of the effluent.

The API gravity index is an arbitrary scale of values proposed by the American Petroleum Institute (API) and the National Institute of Standards and Technology (NIST), used for measuring the density of crude oil. Measurement is in API degrees (° API). The lighter a crude oil (the lower its density), the higher is its API gravity index. In the case of the crudes involved in this installation (heavy oils), the API gravity index is typically comprised between 4 and 17. The formula for determining the API is as follows:

$$\text{API}=(141.5*10^3-131.5)/MV$$

where MV is the density of the effluent.

The density MV of the effluent is calculated as follows:

$$MV=((BHPd-THP)*105)/9.81*H2$$

where BHPd is the discharge pressure of the pump, measured by the sensor 25, where THP is the pressure at the wellhead measured by the sensor 21, and where H2 is the height between the sensors 21 and 25.

Sensors 21 and 25 are detailed in the description below. They measure respectively the wellhead pressure and the pump discharge pressure.

Preferably, the diluent-injection flow-rate is slaved to the rotation speed of the pump.

The feature that the diluent-injection flow-rate is slaved to the API gravity index is a variant. In this variant, the installation authorises a real-time calculation of the API gravity index by the automated device. The installation comprises specific instrumentation suitable for this calculation, in particular the presence of the pressure sensors 21 and 25.

Sensors 21-26, 30, which each measure a physical unit monitored by the automated device 10, are connected to the latter, preferably by a wire connection.

The installation comprises a first pressure sensor 21, located at the wellhead, for example at the inlet of the effluent evacuation pipe 6. The pressure sensor 21 allows the pressure at the wellhead to be measured, which is a first physical unit forming part of the operating conditions. A limit value for the wellhead pressure is pre-programmed in the automated device, for example 25 bars. To ensure that the system experiences satisfactory operating conditions, the wellhead pressure must be below this limit value. If the physical unit measured by the sensor 21 and sent to the automated device 10 is close to or above the pre-programmed value, the automated device will reduce the pump speed and reduce the diluent-injection flow-rate.

The installation comprises a second pressure sensor 25, located at the well bottom, at the pump discharge. The second pressure sensor 25 allows the pump discharge pressure to be measured, which is a second physical unit forming part of the operating conditions. As mentioned above, the measurement of the pump discharge pressure, combined with the measurement of the wellhead pressure, allows the automated device to calculate the API gravity index of the effluent. This is useful in particular when the diluent-injection flow-rate is slaved to the gravity index of the effluent.

The installation also comprises a first temperature sensor 22, located at the wellhead, for example at the entrance to the evacuation pipe 6. The temperature sensor 22 gives a value for the temperature at the wellhead, which is a third physical unit forming part of the operating conditions. This temperature value is homothetically linked to the wellhead flow-rate. The maximum flow-rate is pre-programmed in the automated device by the reservoir engineer, according to quotas fixed for the well. If the wellhead flow-rate is close to or above the pre-programmed value, the automated device will reduce the pump speed and optionally will reduce the diluent-injection flow-rate.

The installation also comprises a second temperature sensor 24, located at the well bottom, for example close to the suction of the pump 20. This temperature sensor 24 allows the well-bottom temperature to be measured, which is a fourth physical unit forming part of the operating conditions. An increase of this physical unit above the values measured in the normal operating conditions indicates a malfunction of the installation. If a hole should form in the tubing 2, effluent present in the tubing would pass through the hole into the annular space 5. Since said effluent has been heated by its passage through the pump 20, the temperature of the effluent close to the pump suction is thus higher than normal once the effluent coming from the tubing has mixed with the effluent at the well bottom. Thus, the temperature of the effluent close to the pump suction, measured by the sensor 24, must be approximately constant while the installation is in operation. If the temperature close to the pump inlet is close to the pre-programmed value, the automated device will reduce the pump speed and optionally will reduce the diluent-injection flow-rate. A variation of approximately 2° C. relative to the values usually recorded indicates a malfunction, and the automated device will progressively reduce the pump speed and optionally the diluent-injection flow-rate until the installation stops. Moreover, the automated device reports a perforation of the tubing to the operator.

The installation comprises a third pressure sensor 23, also located at the well bottom, which measures the pressure at the suction of the pump 20, and a fourth pressure sensor 30, located at the outlet of the casing 1, in the annular space 5, which measures the wellhead gas pressure in the annular space 5. The physical units measured by the sensors 23 and 30 are transmitted to the automated device 10, which calculates the height of the effluent located above the pump. The submersion height is a fifth physical unit forming part of the operating conditions. For a correct operation of the installation, the pump must always be immersed, and a minimum submersion height value is pre-programmed in the automated device by the reservoir engineer.

Calculation of the submersion height of the pump also involves the API gravity index of the effluent (calculated from the measurements carried out by sensors 21 and 25) and the well bottom temperature (measured by sensor 24). If either of these measures is not available, the automated device can use default values to calculate the submersion height of the pump. These default values are provided in advance by the reservoir engineer.

If the submersion height calculated by the automated device is close to or below the pre-programmed value, the automated device will reduce the pump speed and optionally the diluent-injection flow-rate.

If the submersion height calculated by the automated device is close to or above the pre-programmed value, the automated device will optimize the pump speed and optionally the diluent-injection flow-rate.

The installation also optionally comprises a vibration sensor 26, located at the pump discharge. The vibration sensor 26 allows all of the effluent vibrations to be measured along three mutually orthogonal axes, which is a sixth physical unit forming part of the operating conditions. The effluent vibrations must be below a predetermined limit value to avoid malfunctions. For example, a high gas content at the suction or a mechanical problem will lead to vibrations greater than those measured in normal operating conditions. If these vibrations are close to or above the pre-programmed value, the automated device will reduce the pump speed and optionally the diluent-injection flow-rate.

As seen above, the installation optionally comprises a fourth pressure sensor 30, located in the annular space 5. The fourth pressure sensor 30 measures the pressure in the annular space, which is a seventh physical unit forming part of the operating conditions. The pressure in the annular space must not exceed a particular predetermined value, otherwise the gas contained in the effluent passes into the pump suction and causes the latter to break. If the pressure in the annular space is close to or above a value pre-programmed by the reservoir engineer, the automated device will reduce the pump speed and optionally the diluent-injection flow-rate.

All these sensors 21-26, 30, the data from which are monitored by the automated device 10, enable the pump to have the longest possible lifespan. The predetermined limit values are fixed by the user of the installation according to the characteristics of the well.

The hydrocarbons production method will now be described.

Figure 2:
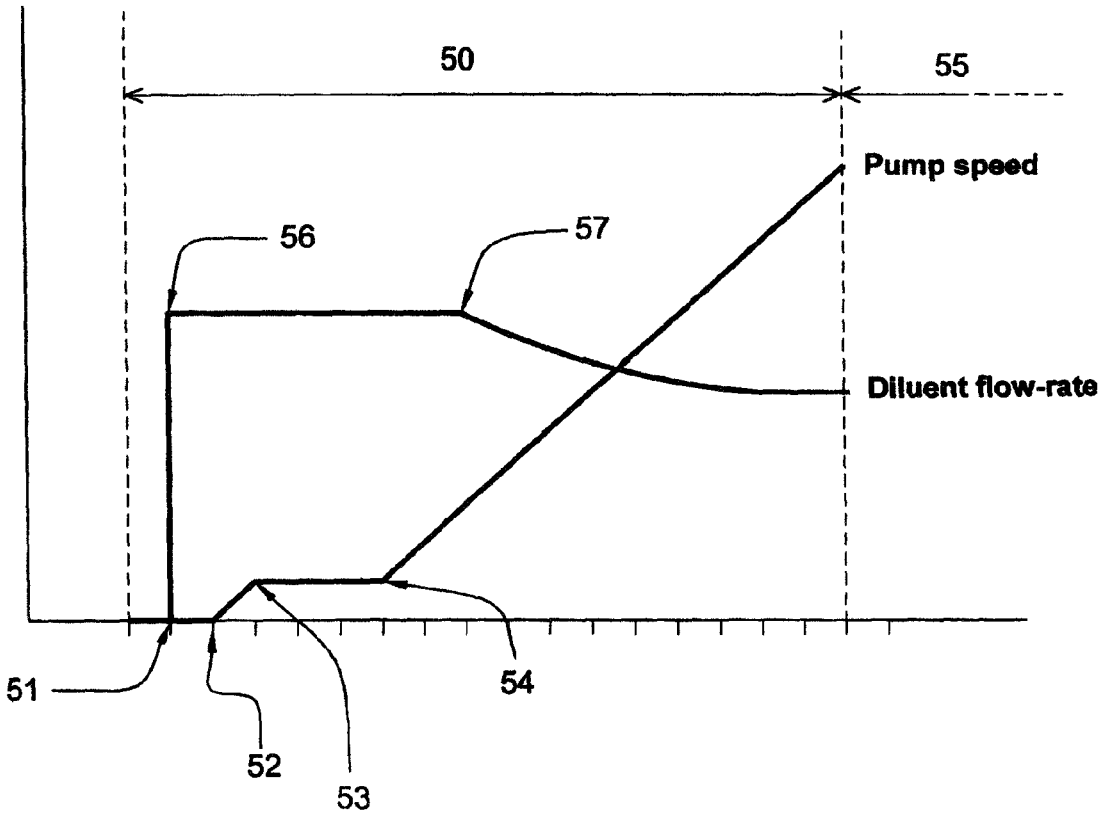

FIG. 2 shows a curve of the speed and the flow-rate of diluent according to time.

As shown in FIG. 2, the hydrocarbons production method comprises at least two phases: a first phase 50, corresponding to the start-up of the well, and a second phase 55, corresponding to the steady mode. The first phase 50 starts with a well preparation step 51. During this step, the automated device 10 opens the valve 13 so as to inject lightening fluid at the bottom of the well. In parallel, the automated device 10 opens the effluent flow-rate regulating valve 7 and the gas flow-rate regulating valve 28. Thus the effluent is ready to be produced and the annular space starts to be ventilated.

The first phase 50 then comprises a step 56 during which the injection of diluent is at its maximum. The diluent flow-rate is equal to a predetermined start-up flow-rate.

The first phase 50 is continued by a step 52. After a delay time triggered in step 51, the automated device 10 starts the pump motor. For this step, the speed is fixed at a first value, for example 50 rpm, so that the pump performs a first acceleration. It is preferable to fill the tubing at low speed.

The first phase 50 is continued by a step 53: when the pump speed has reached the first value, it stabilizes at this speed for a delay time which corresponds to the time necessary for the volume of injected diluent to be equal to twice the volume of the horizontal part of the drain.

The first phase 50 is continued by a step 54: once the speed is stabilized and the volume of injected diluent has reached the desired volume, the pump performs a second acceleration until the target value is reached. As mentioned above, this target value may be an effluent flow-rate value at the wellhead, an effluent pressure value at the pump suction, a pump submersion height or also a predetermined pump rotation speed value. This target value is chosen by the reservoir engineer in a step prior to the first phase 50 of the method.

The first phase 50 is continued by a step 57 of reducing the injection of diluent. This step starts when the volume of diluent injected since step 51 is equal to 3 times the volume of the horizontal part of the drain. The automated device then calculates a target value of the flow-rate of diluent to be injected, according to the type of slaved control chosen (for example slaved to the rotation speed of the pump or the API gravity index). The automated device will then act on the diluent flow-rate regulating valve 13 to reduce the diluent-injection flow-rate, so as to approach the target value. For the whole of the first phase 50, and in particular during this step 57, the operating conditions must be normal, i.e. the pump speed and the physical units must each be comprised within a predetermined range of values. Otherwise, the automated device responds as seen above. Thus, the automated device maintains the pump speed and the physical units each within a predetermined range of values.

The method is continued by the second phase 55, which corresponds to the continuous and stable production mode. The speed is slaved to the chosen production target (flow-rate of the effluent at the wellhead, pressure of the effluent at the pump suction or pump submersion height) while respecting the limitations. The flow-rate of injected diluent is governed either by the rotation speed of the pump or by the API gravity index calculated in real time from the measurements carried out by the pressure sensors, as was seen above. The operating conditions must be normal, i.e. the pump speed and the physical units must each be comprised within a predetermined range of values.

Thus, the automated device 10 commands the installation in real time, by simultaneously regulating the pump speed and optimizing, i.e. minimizing, the quantity of diluent injected according to the physical units, so that the pump speed and the physical units are each comprised, and maintained by the automated device, within a predetermined range of values.

During phase 55, when at least one physical unit leaves the predetermined range of values, the pump speed and the fluid injection flow-rate are increased or reduced by the automated device 10 until each physical unit is comprised once again within the corresponding predetermined range of values. This allows the pump speed and the physical units each to be maintained within a predetermined range of values.

Thus, the invention makes it possible to ensure good operation of the pump and good productivity of the well, while ensuring a minimum consumption of lightening fluid.

The automated device 10 is also connected to the gas flow-rate regulating valve 28 and to the flowmeter 29 that are arranged in the gas-evacuation pipe 27. When the pressure measured by the sensor 30 in the annular space 5 exceeds a predetermined limit value, the automated device 10 can increase the flow-rate of the evacuated gas to reduce the pressure in the annular space 5.

Of course, the present invention is not limited to the embodiments described by way of example; thus, an additional anti-foam or anti-deposit type additive can also be injected into the well by another injection system.

The invention claimed is:

1. A heavy-oil-based hydrocarbons effluent production installation for a production of hydrocarbons from at least one well, the installation comprising:

an effluent-lightening fluid injection system at a bottom of the well;

an effluent-evacuation pump;

a plurality of sensors for measuring physical units relating to the installation; and an automated device for optimizing a lightening-fluid injection flow-rate and for regulating a speed of the pump, according to the physical units and a predetermined target production value, the pump speed and the physical units each within a predetermined range of values, wherein the lightening-fluid injection flow-rate is proportional to a gravity index of the effluent, the automated device performing a real-time calculation of the gravity index of the effluent, wherein one of the sensors is a first pressure sensor located at a wellhead and another sensor is a second pressure sensor located at a discharge of the pump, wherein the automated device is further for calculating a gravity index of the effluent according to data provided by said first and second pressure sensors.

2. The hydrocarbons production installation according to claim 1, wherein one of the sensors is a temperature sensor located at the wellhead, wherein the automated device is further for monitoring an effluent flow-rate at the wellhead according to data provided by said temperature sensor.

3. The hydrocarbons production installation according to claim 1, wherein one of the sensors is a temperature sensor located at a suction of the pump, wherein the automated device is further for monitoring an occurrence of a hole in a tubing evacuating effluent from the pump, according to the data provided by said temperature sensor.

4. The hydrocarbons production installation according to claim 1, wherein one of the sensors is a vibration sensor located at a discharge of the pump, wherein the automated device is further for monitoring an occurrence of excessive pump vibrations according to the data provided by said vibration sensor.

5. The hydrocarbons production installation according to claim 1, wherein one of the sensors is a first pressure sensor located at a suction of the pump and another of the sensors is a second pressure sensor located at an outlet of a casing in an annular space, wherein the automated device is further for calculating a submersion height of the pump according to the data provided by said first and second pressure sensors.

6. The hydrocarbons production installation according to claim 5, wherein the automated device is further for optimizing a height of effluent above the pump by regulating a ventilation of the annular space, wherein the annular space comprises gas.

7. The hydrocarbons production installation according to claim 1, wherein one of the sensors is a pressure sensor located in an annular space, the automated device is further for monitoring a passage of gas through the pump according to the data provided by said pressure sensor.

8. The hydrocarbons production installation according to claim 1, wherein the lightening fluid is a diluent.

9. A heavy-oil-based hydrocarbons effluent production method in an installation that comprises an effluent-lightening fluid injection system at a bottom of a well, an effluent-evacuation pump, a plurality of sensors measuring physical units relating to the installation and an automated device, the method comprising:

in a phase of stable and continuous production mode, implemented by the automated device, the phase of stable and continuous production mode comprising the optimization of the lightening-fluid injection flow-rate and the regulation of the pump speed according to the physical units and a target production value, the pump speed and the physical units each being comprised within a predetermined range of values, wherein the lightening-fluid injection flow-rate is proportional to a gravity index of the effluent, the automated device performing a real-time calculation of the gravity index of the effluent, wherein the installation comprises a first pressure sensor located at a wellhead and a second pressure sensor located at the pump discharge, measurement of the pump discharge pressure, combined with measurement of the wellhead pressure, allowing the automated device to calculate the gravity index of the effluent.

10. The production method according to claim 9 further comprising, before the phase of stable and continuous production mode, a phase of starting-up the well, the phase of starting-up the well comprising:

injecting effluent-lightening fluid at the bottom of the well by the automated device;

starting-up the effluent evacuation pump by the automated device;

stabilizing the pump speed at a first value for a determined period;

increasing the pump speed by the automated device until the target production value is reached;

reducing the rate-flow of injection of lightening fluid;

with the automated device using the plurality of sensors during the phase of starting-up the well to monitor the physical units.

11. The production method according to claim 9 further comprising minimizing the lightening-fluid injection flow-rate and regulating the pump speed by, with the automated device, increasing or reducing the pump speed and the fluid injection flow-rate when at least one physical unit leaves the predetermined range of values until each physical unit is again within the predetermined corresponding range of values.

12. A heavy-oil-based hydrocarbons effluent production installation for the production of hydrocarbons from at least one well, the installation comprising:

an effluent-lightening fluid injection system at a bottom of the well;

an effluent-evacuation pump;

a plurality of sensors for measuring physical units relating to the installation; and an automated device for optimizing a lightening-fluid injection flow-rate and for regulating the speed of the pump, according to the physical units and a predetermined target production value, the pump speed and the physical units each within a predetermined range of values;

wherein the effluent-lightening fluid injection system comprises a valve for regulating lightening-fluid injection flow-rate, wherein the automated device acts on the valve to govern the lightening-fluid injection flow-rate proportionally to the pump speed.

13. The hydrocarbons production installation according to claim 12, wherein one of the sensors is a temperature sensor located at a wellhead, wherein the automated device is further for monitoring an effluent flow-rate at the wellhead according to data provided by said temperature sensor.

14. The hydrocarbons production installation according to claim 12, wherein one of the sensors is a temperature sensor located at a suction of the pump, wherein the automated device is further for monitoring an occurrence of a hole in a tubing evacuating effluent from the pump, according to the data provided by said temperature sensor.

15. The hydrocarbons production installation according to claim 12, wherein one of the sensors is a vibration sensor located at a discharge of the pump, wherein the automated device is further for monitoring an occurrence of excessive pump vibrations according to the data provided by said vibration sensor.

16. The hydrocarbons production installation according to claim 12, wherein one of the sensors is a first pressure sensor located at a suction of the pump and another of the sensors is a second pressure sensor located at an outlet of a casing in an annular space, wherein the automated device is further for calculating a submersion height of the pump according to the data provided by said first and second pressure sensors.

17. The hydrocarbons production installation according to claim 16, wherein the automated device is further for optimizing a height of effluent above the pump by regulating a ventilation of the annular space, wherein the annular space comprises gas.

18. The hydrocarbons production installation according to claim 12, wherein one of the sensors is a pressure sensor located in an annular space, the automated device is further for monitoring a passage of gas through the pump according to the data provided by said pressure sensor.

19. The hydrocarbons production installation according to claim 12, wherein the lightening fluid is a diluent.

* * * * *